US005573198A

United States Patent [19]

Fassman et al.

[11] Patent Number: 5,573,198

[45] Date of Patent: Nov. 12, 1996

[54] TAPE ROLL REWIND DEVICE AND METHOD FOR REWINDING TAPE ON A TAPE ROLL

[75] Inventors: Arnold Fassman, Westport; John R. Nobile, Fairfield; Victor C. Riccardi, Stamford; William A. Ross, Darien; William A. Salancy, Norwalk, all of Conn.

[73] Assignee: Pitney Bowes, Stamford, Conn.

[21] Appl. No.: 382,749

[22] Filed: Feb. 2, 1995

[51] Int. Cl.[6] ..... B65H 16/00; B65H 18/10; B65H 75/48

[52] U.S. Cl. ..... 242/375; 242/546

[58] Field of Search ..... 242/546, 375, 242/251, 252, 351, 545.1; 185/13, 43

[56] References Cited

U.S. PATENT DOCUMENTS

| | | | |
|---|---|---|---|
| 1,620,726 | 3/1927 | Howell | 185/43 |
| 1,872,098 | 8/1932 | Thomas | 242/546 |
| 3,044,724 | 7/1962 | Goodwin | 242/546 X |
| 3,079,812 | 3/1963 | Bross | 185/43 |
| 3,294,198 | 12/1966 | Pfeffer | 185/43 |
| 4,842,215 | 6/1989 | Takami | 242/546 |
| 5,076,510 | 12/1991 | Norlander | 242/375 |

FOREIGN PATENT DOCUMENTS

| | | | |
|---|---|---|---|
| 540574 | 10/1941 | United Kingdom | 185/43 |

*Primary Examiner*—John M. Jillions
*Attorney, Agent, or Firm*—Steven J. Shapiro; Angelo N. Chaclas; Melvin J. Scolnick

[57] ABSTRACT

A tape roll rewind device includes a rotatable tape spool with tape wound thereon; and a device for 1) storing energy in response to rotation of the tape spool in a first direction, 2) storing a maximum amount of energy regardless of the amount of rotation of the tape spool in the first direction, and 3) utilizing the stored energy to rotate the tape spool in a second direction to rewind tape onto the tape spool upon the ending of rotation of the tape spool in the first direction.

8 Claims, 2 Drawing Sheets

TAPE ROLL REWIND DEVICE AND METHOD FOR REWINDING TAPE ON A TAPE ROLL

BACKGROUND

This invention relates to a device for rewinding excess tape around a spool, and more particularly to a device for regulating the amount of tape rewound in a mail handling machine.

This invention is an improvement to the tape feeding, cutting and ejecting apparatus utilized in a mailing machine as set forth in U.S. Pat. No. 5,392,703, issued on Feb. 28, 1995, (assigned to the assignee of the present invention) which is hereby incorporated by reference. The mailing machine of the aforementioned application has the capability of printing postage indicia onto an envelope or a piece of tape depending on the selection made by the machine operator. If the tape option is selected, tape is pulled from a supply roll of tape wound around a spool by a plurality of feed rollers. The feed rollers feed the tape:to the nip between a printing drum and an impression roller where printing of the indicia on the tape occurs. However, once printing has been completed, the feed rollers drive the tape back towards the supply roll to accomplish cutting and ejecting of the printed portion of the tape, and to move the end of the tape of the supply roll into a predetermined position to start the next tape printing cycle.

In the aforementioned mailing machine the pushing of the excess tape toward the supply roll creates a loose tape loop around the supply roll which is guided into position by a plurality of guide rollers. While this configuration works well in most instances, there are times where the excess tape that has been pushed back around the supply roll can cause the tape feeding, cutting and ejecting apparatus to malfunction. That is, in the low profile mailing machine of the aforementioned application, there is a minimal amount of clearance between the tape supply roll and the surrounding cover and housing of the mailing machine in which to receive the excess tape (as well as additional excess tape due to inertial torque). Thus, at times, the excess tape can become trapped in the clearance. The trapped tape is prevented from being properly fed during subsequent printing cycles which can lead to a failure to feed tape, tape jams, or varying tape margins due to the inconsistent feeding. Moreover, if the glued portion of the tape becomes wet, it is possible that the individual tape roll layers may stick together causing jamming of the tape during the pushing back operation.

Thus, what is needed is a mechanism which can automatically rewind a predetermined amount of tape each time tape is pulled from the tape supply roll in order to accommodate for excess tape generated during the tape printing cycle of a mailing machine.

SUMMARY OF THE INVENTION

It is an object of the invention to provide a tape roll rewind device which regulates the amount of tape rewound onto a spool.

It is a further object of the invention to provide a tape rewind device that is simple in construction and which automatically operates in response to the unwinding of tape from the spool.

The above objects are met by providing a tape roll rewind device having a rotatable tape spool with tape wound thereon; and means for 1) storing energy in response to rotation of the tape spool in a first direction, 2) storing a maximum amount of energy regardless of the amount of rotation of the tape spool in the first direction, and 3) utilizing the stored energy to rotate the tape spool in a second direction to rewind tape onto the tape spool upon the ending of rotation of the tape spool in the first direction.

Yet another object of the invention is to provide a method for rewinding tape on a tape spool. This object is met by a method comprising the steps of:

A) rotating the tape spool in a first direction to unwind tape from the tape spool;

B) storing energy in an energy storage device in response to rotation of the tape spool in the first direction;

C) preventing the storing of more than a maximum amount of energy in the energy storage device regardless of the mount of rotation of the tape spool in the first direction;

D) stopping the rotation of the tape spool in the first direction; and

E) utilizing said stored energy in said stored energy device to rotate the tape spool in a second direction thereby rewinding tape onto the tape spool upon the ending of rotation of the tape spool in the first direction.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figures 1, 3:
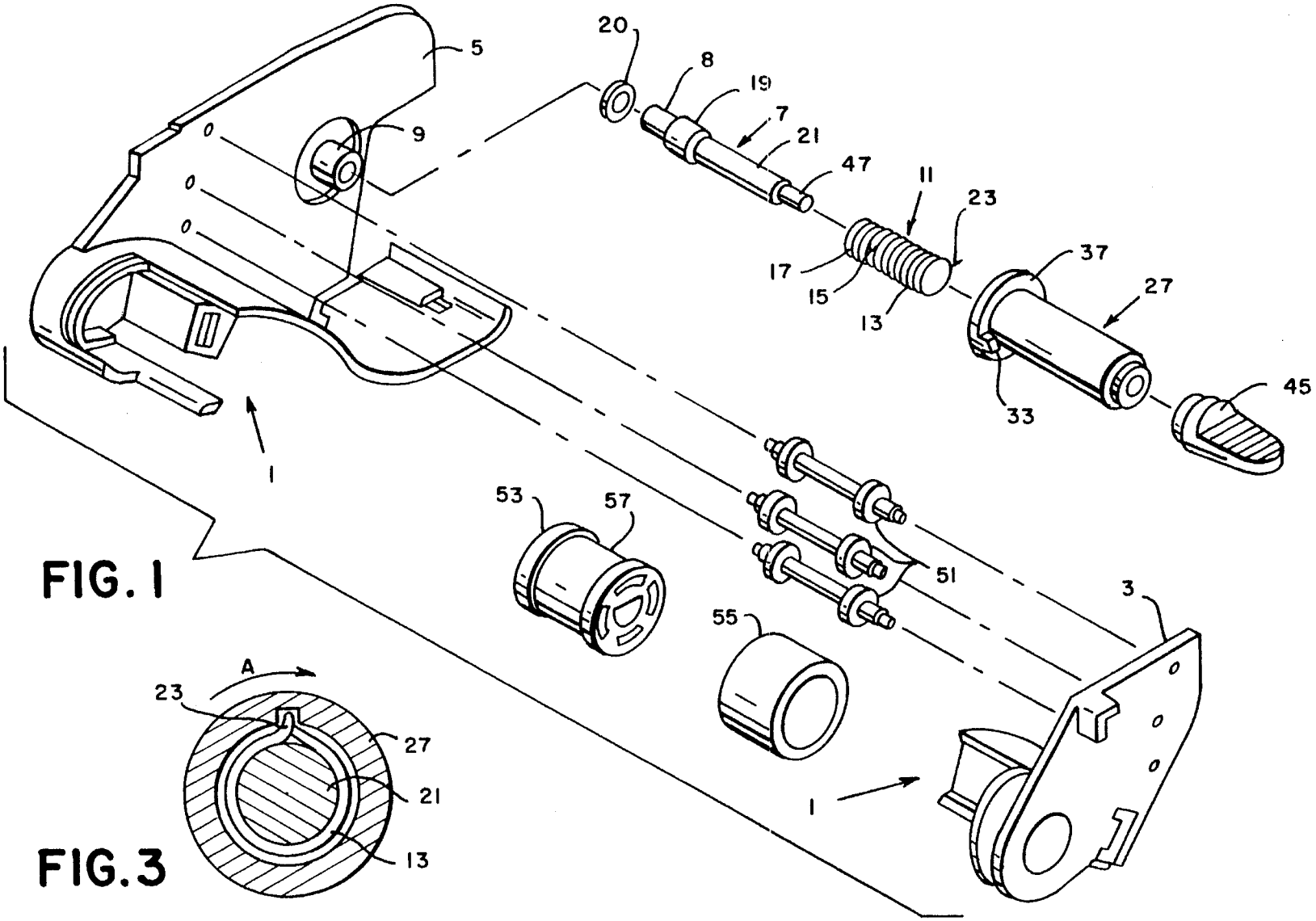
FIG. 1 is an exploded perspective view of the invention incorporated in a portion of a mailing machine.
FIG. 3 is a cross-section of the confiner tube, shaft, and torsion spring portion.
Figure 2:
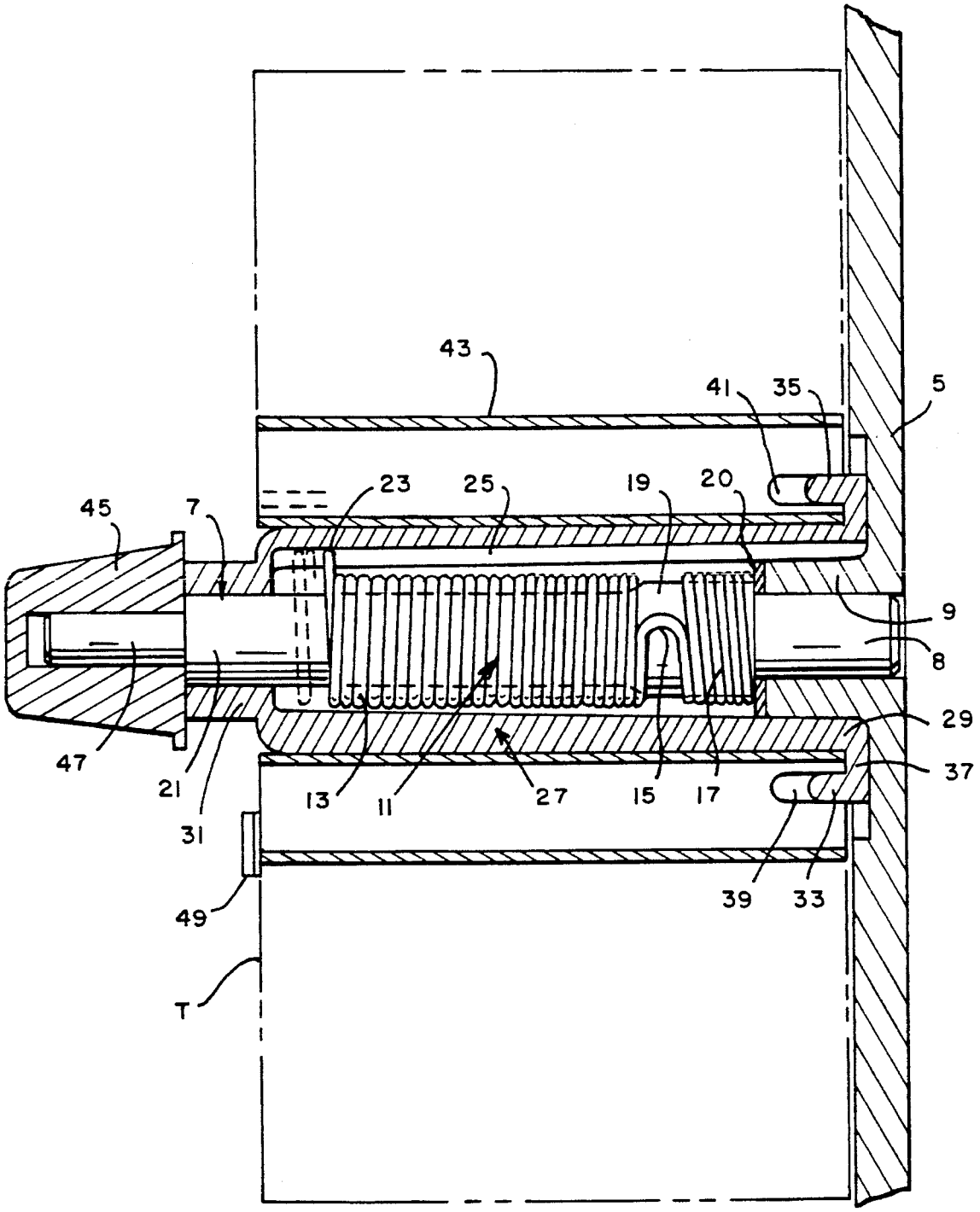
FIG. 2 is an enlarged cross-section of the inventive apparatus.

Referring to FIGS. 1 and 2, a preferred embodiment of the inventive tape roll rewind device will be described. A tape supply roll housing 1 includes first and second portions 3, 5. The tape supply roll housing 1 is movable within the mailing machine between an operational position and a tape removal/insertion position as is more fully described in U.S. Pat. No. 5,392,703. A shaft 7 is fixedly mounted, via a first portion 8, in a hub 9 integrally formed as part of second housing portion 5. A spring device 11 which is used to store and release energy as described in more detail below, is disposed around shaft 7. Spring 11 includes a torsion spring portion 13, an arcuate shaped transition portion 15, and a wrap spring slip clutch portion 17. The torsion spring portion 13 and wrap spring clutch portion 17 are wound around shaft 7 in opposite directions from each other and are connected to each other via transition portion 15, thereby forming a single continuous spring device. The internal diameter of the individual coils of the wrap spring clutch portion 17 is such that there is interference between the individual coils and the outside diameter of a second portion 19 of shaft 7. Thus, wrap spring slip clutch portion 17 is forcibly placed around first portion 19 such that the individual coils thereof are forced to stretch slightly and grip shaft portion 19, thereby retaining wrap spring slip clutch portion 17 in place on shaft 7. The end of wrap spring slip clutch portion 17 opposite from transition portion 15 is free and bears against a steel washer 20 to prevent wear on hub 9 during movement of wrap spring slip clutch portion 17 as is discussed in more detail below.

Torsion spring portion 13 has individual coils that are wrapped around a third portion 21 of shaft 7 such that there is no contact between the inner diameter of the torsion spring portion coils and the outer diameter of third portion 21. Moreover, torsion spring portion 13 has a tang 23 at one end thereof which is disposed in a slot 25 in a container tube 27 that is mounted for rotation about shaft 7. Container tube 27 has a first end 29 supported on and rotatable about hub 9 and a second end 31 supported on and rotatable about third portion 21 of shaft 7. Additionally, container tube 27 has two projections 33, 35 extending from a flange 37 thereof which each project into corresponding openings 39, 41 in a tape spool 43. Thus, as container tube 27 rotates about shaft 7, tape spool 43 rotates therewith to unwind or wind tape "T" about spool 43 depending on the direction of rotation of container tube 27.

A cover 45 is fixedly disposed about end portion 47 of shaft 7 such that container tube 27 is captured between cover 45 and second housing portion 5. The cover 5 is dimensioned so that tape spool 43 can be slid to the left in FIG. 2 and removed over cover 45. Moreover, when the housing 1 is in the operating position, tape spool 43 can be kept in place by its positioning between a finger 49 extending from another wall of the mailing machine and the second housing portion 5.

Referring to FIG. 1, three free wheeling rollers 51 are shown as being disposed between the first and second portions 3, 5 of housing 1. Rollers 51 are used to guide tape "T" to feed roller 53. Feed roller 53 has a friction material 55 disposed around a central portion 57 thereof to prevent slipping of the tape "T" as it passes around feed roller 53. While not shown in the drawings, feed roller 53 cooperates with an idler roller such that the tape "T" passes between the nip between the feed roller 53 and idler roller. As feed roller 53 is forced into rotation by a motor, as is more fully described in the aforementioned patent incorporated herein by reference, the tape "T" is pulled thereby forcing spool 43 into rotation to allow for the unwinding of tape "T" and its subsequent feeding to the printing drum by feed roller 53.

While the above provides a detailed description of the inventive structure, a description of the operation of the inventive tape spool rewind device will now be set forth. As previously mentioned, when the operator selects the tape print function, feed roller 53 is forced into rotation to pull tape "T" from spool 43. As spool 43 is forced into rotation in the direction of arrow "A" of FIG. 3, confiner tube 27 is forced to rotate therewith due to the interaction between projections 33, 35 of confiner tube 27 and openings 39, 41 of spool 43. Since tang 23 of torsion spring portion 13 is captured in slot 25 of confiner tube 27, torsion spring portion 13 is forced to close down as confiner tube 27 rotates. As the coils in torsion spring portion 13 close down toward third portion 21 of shaft 7, energy is stored in torsion spring portion 13 which therefore acts as an energy storage device. The dashed lines in FIG. 2 represent torsion spring portion 13 in a closed down position whereas the solid lines represent its position prior to that.

The energy stored in torsion spring portion 13 will subsequently be used to rotate the confiner tube 27 back to its original position upon the feeding of the tape "T" in the reverse direction as will be discussed in more detail below. However, a problem exists with respect to the ever changing diameter of the outside of the tape "T" on the spool 43. That is, as the tape "T" is removed from the roll, its outside diameter decreases. Thus, a fixed length of tape pulled from a decreased diameter causes an increase in angular rotation of spool 43 and attached confiner tube 27. In the particular mailing machine of the application incorporated by reference, the angular rotation of the tape roll increases by approximately a factor of three from a full roll to its core. Therefore, in the situation where the supply roll is almost exhausted, the torsion spring portion 13 can be over wound beyond that necessary to rewind the excess tape or even to the point where the torsion spring portion would close down on the shaft impacting the feeding of tape.

To prevent the excessive over winding of the torsion spring portion 13, the wrap spring slip clutch portion 17 is designed to slip at a predetermined amount of rotation necessary to ensure the complete rewinding of the excess tape "T". That is, when the confiner tube 27 is rotated to the position where the torsion spring portion 13 is at its required torque in order to ensure rewinding of the excess tape, further rotation of the confiner tube 27 causes the wrap spring slip clutch 17 to unwind and slip on shaft 7. This action is created because as the torsion spring portion 13 is being closed down, the force exerted on transition portion 15 of spring 11 tends to pull transition portion 15 down and away from wrap spring slip clutch portion 17. When this pulling force exceeds the clamping force of wrap spring slip clutch portion 17 about shaft 7, the coils of wrap spring slip clutch portion 17 will begin to unwind allowing wrap spring slip clutch portion 17 to slip about shaft 7. As the tape "T" continues to be pulled from the spool 43, torsion spring portion 13 will only have the amount of energy stored therein in order to rewind the excess tape and will not become overwound due to the slipping of wrap spring slip clutch 17.

Once tape "T" is no longer being fed to the print drum and the feed roller 53 is reversed to push the excess tape "T" back toward spool 43, the torsion spring portion 13 wants to return to its initial position and it unwinds to rotate the confiner tube 27 and spool 43 in the opposite direction of the feed direction, thereby rewinding excess tape onto the spool 43. Moreover, at the point where the feed roller 53 pushes the tape "T" back toward the spool 43, the wrap spring slip clutch 17 closes down on shaft 7 and no longer slips thereon permitting the torsion spring portion 13 to rewind the excess tape.

The reason that the wrap spring slip clutch portion 17 unwinds in relation to the winding down of the torsion spring portion 13 is because the coils of the wrap spring slip clutch portion 17 are wound directly opposite to the winding of coils in the torsion spring portion. Moreover, based on the inventive structure set forth herein, one possessing ordinary skill in the art could design the inventive spring 11 such that the wrap spring slip clutch portion 17 will slip at any given torque value of the torsion spring portion 13 depending upon the conventional parameters used in specifying springs.

It is also important to note that while the inventive apparatus has been shown incorporated in connection with a tape supply spool of a tape feeding, cutting and ejection apparatus, it is not limited to such application but can be utilized in any device where a predetermined rewind of a spool is required. Moreover, additional advantages and modifications will readily occur to those skilled in the art. Therefore, the invention in its broader aspects is not limited to the specific details, and representative devices, shown and described above. Accordingly, various modifications may be made without departing from the spirit or scope of the general inventive concept as defined by the appended claims and their equivalents.

What is claimed is:

1. A tape roll rewind device comprising:

a rotatable tape spool with tape wound thereon; and means for 1) storing energy in response to rotation of said tape spool in a first direction, 2) storing a maximum amount of energy regardless of the amount of rotation of tape spool in said first direction, and 3) utilizing said stored energy to rotate said tape spool in a second direction to rewind tape onto said tape spool upon the ending of rotation of said tape spool in said first direction, wherein said energy storing means includes a spring operatively connected to said tape spool, said spring having a torsion spring portion and a wrap spring slip clutch portion which are connected to each other to form a continuous spring device.

2. A tape roll rewind device as recited in claim 1, further comprising a shaft about which said tape spool, said torsion spring portion, and said wrap spring slip clutch portion are disposed, said wrap spring slip clutch portion clamped onto said shaft, and wherein during rotation of said tape spool in said first direction said torsion spring portion closes down around said shaft storing said energy until said tape spool is rotated a predetermined distance whereupon said wrap spring slip clutch portion slips on said shaft preventing any further storage of energy in said torsion spring portion regardless of any additional rotation of said tape spool in said first direction.

3. A tape roll rewind device as recited in claim 2, wherein said torsion spring portion includes a plurality of coils wound around said shaft in a first coil direction and said wrap spring slip clutch portion includes a plurality of coils wound around said shaft in a second coil direction opposite to said first coil direction.

4. A tape roll rewind device as recited in claim 3, further comprising a confiner tube disposed around said spring and said shaft and operatively connected to said tape spool to rotate therewith, said confiner tube having a slot therein in which a portion of said torsion spring portion is disposed such that as said confiner tube rotates in said first direction with said tape spool said torsion spring portion closes down around said shaft and stores said energy therein.

5. A tape roll rewind device as recited in claim 4, wherein said spring further comprises an intermediate arcuate shaped portion connecting said torsion spring portion and said wrap spring slip clutch portion to each other.

6. A tape roll rewind device as recited in claim 5, further comprising a cover mounted on a first end of the shaft to prevent said spring and said confiner tube from being removable over said first end.

7. A device for rewinding a rotatable spool disposed around a shaft, said device comprising:

a torsion spring connected to the spool such that said torsion spring stores energy therein in response to rotation of the rotatable spool in a first direction;

a wrap spring clutch connected to said torsion spring to form a continuous spring device such that said wrap spring slip clutch remains in a fixed position during rotation of the rotatable spool a predetermined amount in the first direction, and when said rotatable spool rotates in the first direction beyond said predetermined amount said wrap spring slip clutch is free to slip preventing storage of additional energy in the torsion spring regardless of rotation of the rotatable spool beyond the predetermined amount.

8. A method for rewinding tape on a rotatable tape spool, the method comprising the steps of:

A) rotating the tape spool if a first direction to unwind tape from the tape spool;

B) storing energy in a torsion spring portion of a spring in response to rotation of the tape spool in the first direction;

C) preventing the storing of more than a maximum amount of energy in said torsion spring portion regardless of the amount of rotation of the tape spool in the first direction by utilizing a wrap spring slip clutch portion of said spring which is connected to said torsion spring portion to form a continuous spring device;

D) stopping the rotation of the tape spool in the first direction; and

E) utilizing said stored energy in said torsion spring portion to rotate the tape spool in a second direction thereby rewinding tape onto the tape spool upon the ending of rotation of the tape spool in the first direction.

* * * * *